United States Patent [19]

Evans et al.

[11] 4,200,920

[45] Apr. 29, 1980

[54] ARTIFICIAL UNDERWATER TARGET

[75] Inventors: David J. Evans; Clark F. Bradley, both of San Diego, Calif.

[73] Assignee: The United States of America as represented by the Secretary of the Navy, Washington, D.C.

[21] Appl. No.: 573,577

[22] Filed: Feb. 29, 1956

Related U.S. Application Data

[62] Division of Ser. No. 656,104, Mar. 21, 1946.

[51] Int. Cl.[2] ..... B63G 8/22; H04K 3/00

[52] U.S. Cl. ..... 367/1; 114/25

[58] Field of Search ..... 114/20–25, 114/18; 116/27; 102/11, 12, 21; 340/5 D

[56] References Cited

U.S. PATENT DOCUMENTS

| | | | |
|---|---|---|---|
| 1,097,700 | 5/1914 | Whiting | 114/20 |
| 1,348,152 | 8/1920 | Conlin | 114/20 |
| 1,515,195 | 11/1924 | Elia | 102/13 |
| 1,527,782 | 2/1925 | Brandt et al. | 114/20 |
| 1,803,530 | 5/1931 | King et al. | 114/20 |
| 2,409,169 | 10/1946 | Whittaker | 114/20 |
| 2,411,393 | 11/1946 | Smith | 114/20 |
| 2,447,651 | 8/1948 | Jennings et al. | 114/20 |

*Primary Examiner*—Richard A. Farley
*Attorney, Agent, or Firm*—G. J. Rubens

EXEMPLARY CLAIM

1. In combination in a free, underwater craft, a hull, means for carrying ballast, means for discharging said ballast, depth responsive means, a timer providing two time intervals, control means operated by said timer for actuating said discharging means after a pre-set time interval, and other control means operated by both said timer and said depth reponsive means for actuating said discharge means after a shorter time interval if said craft attains a pre-set depth.

1 Claim, 3 Drawing Figures

ARTIFICIAL UNDERWATER TARGET

This is a division of application Ser. No. 656,104, filed Mar. 21, 1946.

The present invention relates to underwater sound apparatus, and particularly to artificial targets.

Objects of the invention include the provision of an improved artificial target suitable for use both as a decoy and also as a practice target, the provision of improved apparatus for the simulation of the self-noise of a submarine, and the provision of improved launching and retrieving means for a free, artificial target.

This device is adapted to be launched from a submerged submarine on a pre-determined course and at a pre-determined depth and, at a pre-determined time after launching, it begins generating noises that simulate the self-noise generated by a submerged submarine. At the same time the device repeats any echo-ranging pings of a searching ship that are directed at the device so as to simulate the reflecting characteristics of a submerged submarine.

The invention described herein is useful in training sound operators in the task of locating submerged submarines and it is useful also in combat as a decoy for misleading vessels that are searching with underwater detection gear for submerged submarines.

For training purposes the device is adjusted to remain submerged while simulating, in sound and movement, a submerged submarine, and after a run of approximately 20 minutes to rise to the surface to be recovered. It is adapted to be launched either from a submarine torpedo tube, or from a surface vessel or small boat.

For combat purposes the device may be launched from a submerged submarine that is under attack. When so used, it is adjusted to continue underway until its source of power is exhausted, and then to sink to the bottom so as to eliminate the possibility of the enemy ever discovering that a submarine decoy had been in the water. While the attention of the searching ship is thus diverted to the decoy the launching submarine may attempt an escape or an attack. In the drawings.

Figure 1:
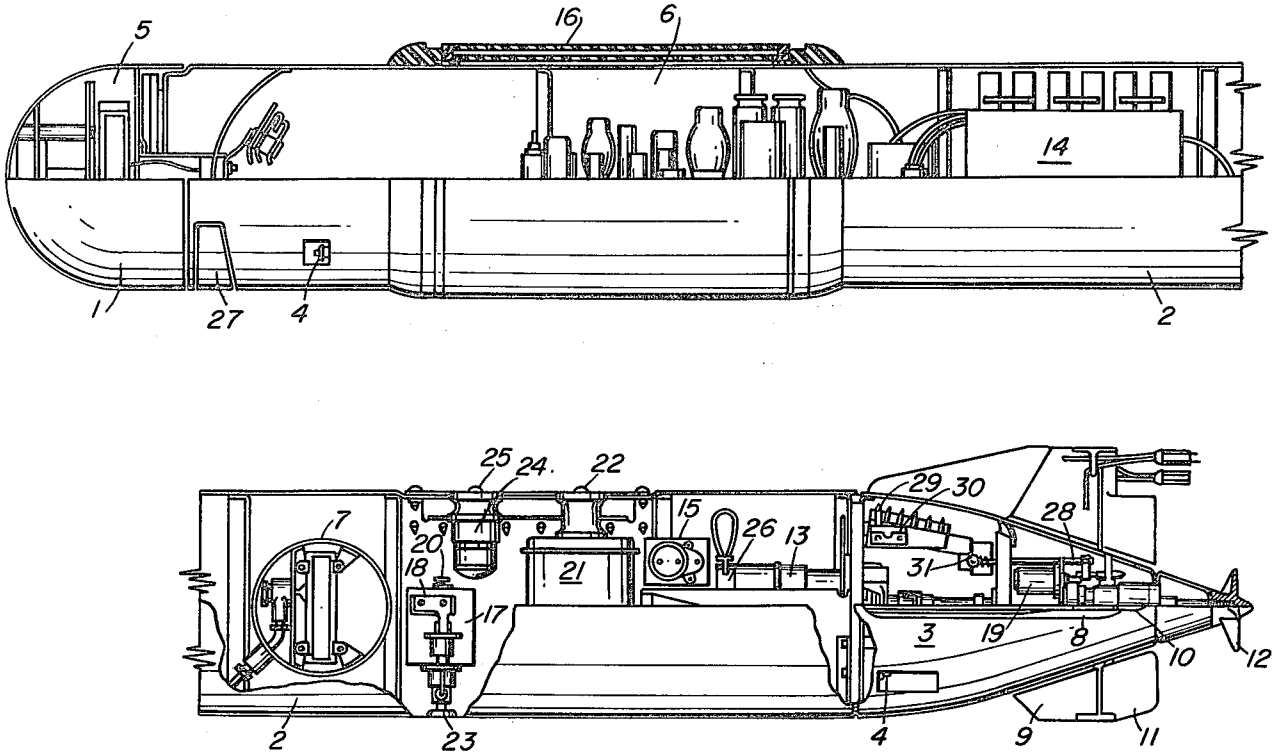
FIG. 1 is an elevation, partly in section, of the device of the present invention.

FIG. 1 shows the general arrangement of the artificial target of the present invention, which consists primarily of a nose section 1, main body section 2, and an afterbody section 3. The assembly of these sections forms a cylindrical unit 101 inches long and 11 inches in maximum diameter. The nose section is spherical at its forward end and the afterbody section is conical, the apex being at the rear. Both the nose and tail sections are attached to the main body by recessed bolts 4. Horizontal stabilizer fins 8 and vertical stabilizer fins 9 support elevators 10 and rudders 11.

A propeller 12 is coupled to a drive motor 13 which is driven by a 12 volt lead-acid battery 14. The drive motor 13 has two speeds which drive the target at 7 knots for launching and 3-¾ knots for cruising, the change of speed of the drive motor being controlled by a sequence timer 15, which will be described presently.

The simulated submarine noises are generated by electronic means within the amplifier 6 and projected into the water by means of a sonic loudspeaker 16. These noises are generated at frequencies ranging from 100 cycles per second into the supersonic frequencies. The noises that are simulated include: a gear whine, the fundamental frequency of which isvariable between 250 cps to 350 cps, and propeller cavitation noises that are adjustable for simulating noises from propellers operating between 80 and 140 turns per minute. The amplitude of the gear whine is adjustable.

The echo repeater equipment which operates in the supersonic range (as for example from 15 to 30 kilocycles per second) consists of a receiving transducer 5 in the nose, an amplifier 6 and a transmitting transducer 7 in the side of the device, well aft. The receiving transducer 5 and the transmitting transducer 7 are each constructed of two sets of rochelle-salt, Y-cut crystals that have their driving surfaces facing horizontally outboard, perpendicular to the longitudinal axis, so as to give an optimum response pattern. The two sets of crystals in the receiving transducer are connected in parallel 180° out of phase with each other so that their electrical outputs are opposed. The two sets of crystals in the transmitting transducer are connected in a parallel arrangement and operate in phase. The connection of the transducers in this manner reduces acoustical coupling (feedback) between the two units.

Just aft of the transmitting transducer 7 is a depth control 17 which contains a hydrostatic switch 18 that is operated by external water pressure through an orifice 23 in the bottom of the device. This switch controls two depth control solenoids 19, of which only one is shown in FIG. 1, that actuate the elevators 10. An adjustment screw 20 on the depth control 17 provides a means of pre-setting the depth at which the device will run.

An electric course-control gyro 21 provides a means of keeping the device on a straight course and a course dial 22 on top of the hull provides a means of selecting the course of the device relative to its launched direction. The course setting is adjustable up to 90° left or right of the launched direction. The course control gyro 21 controls solenoids 82 (not shown in FIG. 1) that operate the rudders 11.

An electric clock 24 is mounted in the main body section 2 and a dial 25, graduated from 0 to 10 minutes, for setting the clock is set flush in the top external surface of the device. This so called "silent-run" clock controls the interval of time (up to 10 minutes) that the device will run silent, after launching, before B + power is supplied to the tubes of the amplifier 6 for the echo repeater and noise generator equipment for activating these sound radiating means.

An electrically driven sequence-timer 15 controls the operation of various units in sequence as will be described presently.

A so called "practice plug" 26 provides a control means for operating the target as a recoverable unit during practice operations. The practice plug 26 is connected in series with an electric relay 95 and a solenoid 96 (to be described in connection with FIG. 5) that release a lead "retriever-weight" 27 that is set in a well or socket in the nose. With the retriever weight 27 attached the target is negatively buoyant but when the retriever weight is dropped at the end of a practice run the device becomes positively buoyant and rises to the surface. For combat operations the practice plug 26 is removed to disable the solenoid 96 and the retriever weight remains attached to cause the target to sink to the bottom when its batteries become exhausted.

Extending through the upper surface of the afterbody 3 (FIG. 1) are three spring-loaded plungers of which only two, 28 and 29, are shown. These plungers are connected to switches 30 and 31 that are used to arm and release the target.

Figures 2, 3:
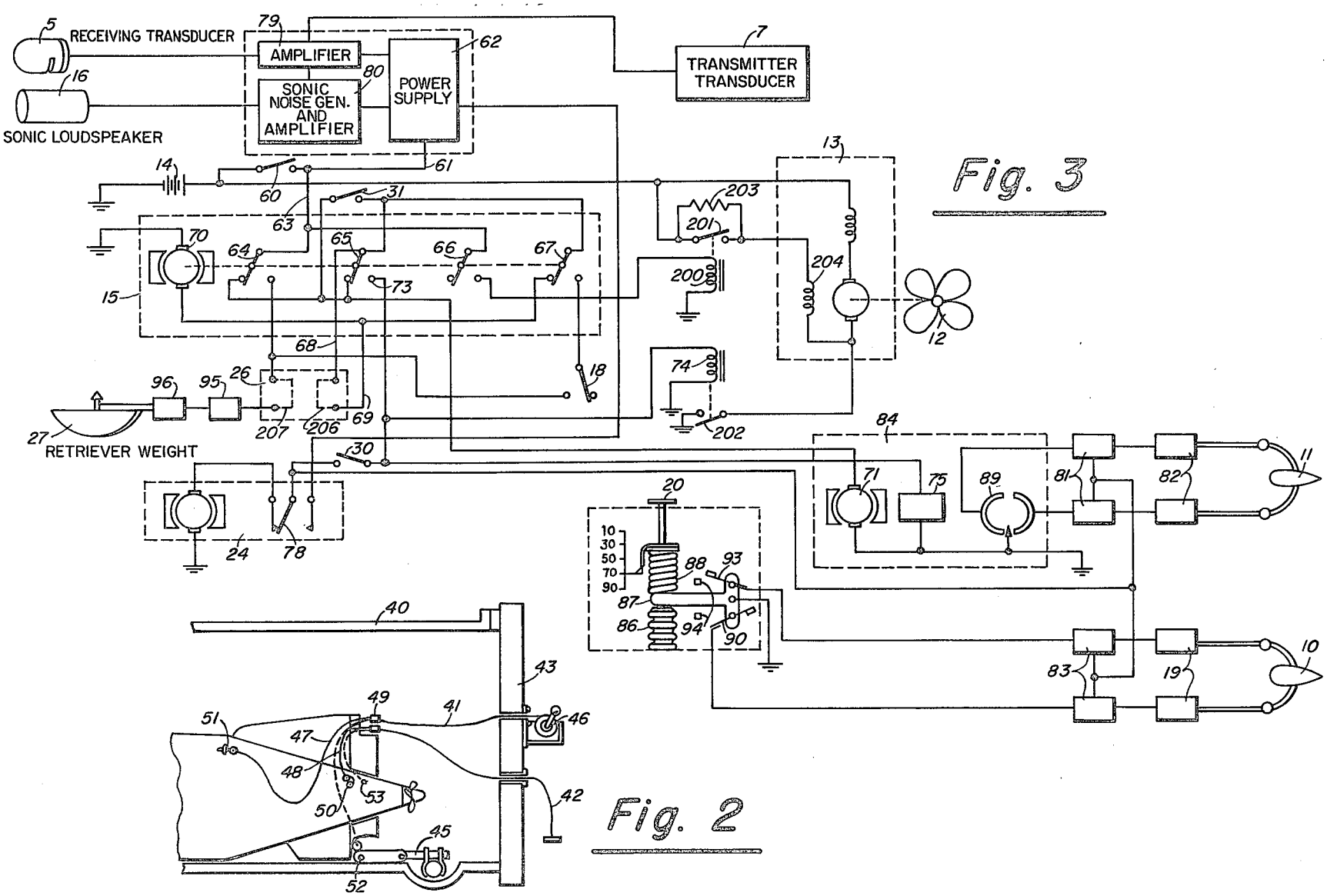
FIG. 2 is a fragmentary view showing the rigging of the device for launching it from a torpedo tube of a submarine.
FIG. 3 is a schematic diagram of the electric circuits of the device.

FIG. 2 shows the arrangement of arming and releasing cables for the present invention when installed in a submarine torpedo tube 40. The arming cable 41, and the releasing cable 42 extend through the breech door 43 of the torpedo tube and each cable is coupled to two short lengths of cable that are connected to pins on the afterbody of the target. The arming cable 41 is operated from a reel 46 and is connected to two short cables 47 and 48. Cable 48 is rigged with less slack than cable 47 and when cable 41 is reeled onto reel 46 the arming pin 50 is pulled, thus setting in operation certain units of the target, which will be explained presently. The so called "simulation-safety-pin" 51 is not pulled at this time because the coupling 49 hits the breech door 43 before the slack in cable l3 47 is exhausted.

After the release cable 42 is pulled removing simultaneously pin 52 which releases the target from the clamp 45, and pin 53, which closes switch 31 (FIG. 3) that starts the drive motor and timer, the target swims toward the outer end of the torpedo tube, during which time cable 41 is drawn from the reel 46. When the target clears the end of the torpedo tube the cable 41 is completely unreeled and being fastened to the reel 46 applies sufficient pull on the cable 47 to pull the pin 51 and close the simulation safety switch. At the closing of the simulation switch the "silent run" clock is started as previously described. Thus the echo repeater and sonic simulation apparatus are not set in operation until the target has cleared the torpedo tube so as to avoid any danger of the target radiating noises while in the tube.

Operation of the component parts of the present invention are as follows: The pulling of the arming pin 50 by cable 48 as already described, closes arming switch 60 (FIG. 3) to connect power through line 61 to the amplifier filaments and at the same time connects power through line 63 and switch 64 to the sequence-timer motor 70 and the gyro rotor motor 71. After the sequence timer runs for 45 seconds the switch 65 is moved to its oppositeposition, thereby stopping the sequence-timer motor 70. This 45-second period is provided between the arming and releasing operations to allow the gyro rotor 71 to come up to operating speed and the amplifier filaments to warm up before the target can be released.

Thereafter when lanyard 42 (FIG. 2) is pulled, switch 31 in FIG. 3 closes to supply power through switch 65, (which is now contacting terminal 73) to the drive motor starting relay 74, to the gyro uncaging solenoid 75, and to the "simulation safety switch" 30, which is still open. Relay 74 closes switch 202 which energizes the drive motor 13 to propel the target at high speed for launching (approximately 7 knots). When the target reaches the end of the torpedo tube the simulation safety switch 30 is closed by cable 41 as previously explained, and power is supplied to the "silent-run" clock 24 which runs for a pre-set time before closing switch 78 which supplies power to the power supply 62 which in turn supplies B + power to the tubes of amplifiers 79 and 80. The silent run period of the target after leaving the torpedo tube is important in combat operations for concealing the location of the launching submarine. The target does not begin transmitting noise or repeating pings until the end of the silent run period, during which time the submarine and the target can move a considerable distance apart.

At the closing of the simulation safety switch 30 the course control relays 81 and the depth control relays 83 are energized, thereby completing the circuits for the operation of the course control unit 84 and the depth control unit 17. The course control unit 84 is a gyroscopic mechanism employing an electrically driven gyro rotor 71 and a stator 89 having a course selector dial on top of the target permitting adjustment for a course up to 90° to left or right of the launched direction.

The depth control unit 17 employs a pair of mercury switches 90 and 93 that are operated by water pressure in connection with a spring 88 which regulates the movement of an arm 87 which supports the mercury tubes. An adjustment screw 20 provides a means of regulating the force of said spring against the arm 87 and a scale attached to the adjustment screw 20 provides an index for setting the spring pressure to operate the target at a desired depth.

The mercury switches 90 and 93 are so adjusted that they energize one or the other of elevator solenoids 19 whenever arm 87 is 1° or more from a horizontal position. Thus the mercury switches, by controlling elevator 10, will tend to regulate the angle of climb or dive of the target so as to hold the arm 87 in a level position. Should the target be launched from, or otherwise attain, a depth that is not the same as the setting of the adjustment screw 20, the difference in the water pressure for the depth set on screw 20 and the water pressure at the target depth in the bellows 86 will move the arm 87 so that it lies at an angle to the axis of the hull. Thereupon the mercury switches 90 and 93 so control elevator 10 as to return arm 87 to a level position and thereby put the target into a climb or dive. The movement of the arm 87 is limited by stops 94 to 14° above or below the longitudinal axis of the target, thereby limiting the angle of climb or dive of the target to a like figure. Maximum movement of the arm 87 is obtained only when the water pressure in the bellows 86 is equivalent to a depth error of 50 ft. or more from the setting of the adjustment screw 20. Water pressure differences equivalent to an offsetting depth of less than 50 ft. will move the arm 87 a part of its 14° travel as shown in FIG. 6. Thus the depth control can be said to have proportional characteristics in that it gradually reduces the angle of climb or dive as the target approaches its proper depth and prevents overcontrol or "searching."

One minute after the target is launched, switch 66 closes and power is supplied to relay 200 which closes switch 201. Closing switch 201 shorts out resistor 203, which is in series with the drive motor field winding 204, and reduces the speed of the target to 3.75 knots, which is a reasonable speed for a submerged submarine. The 7 knot speed is necessary during the launching period to allow the target to clear the submarine when the target is launched from a bow torpedo tube while the submarine is moving ahead.

Five minutes after launching the target the switch 67 is moved to its opposite position, thus supplying power to a hydrostatic switch 18 and to the sequence-timer motor 70. The hydrostatic switch is set to close when the target is below the 100-foot depth and is set to open above this depth. The hydrostatic switch is connected to the retriever-weight-release-solenoid 96 and is a safety device that prevents the target from sinking to a depth greater than 100 feet during practice runs. Since the target may be launched from a submerged depth of greater than 100 feet, and the normal operating depth is between 10 and 90 feet, the switch 67 delays the operation of the hydrostatic switch 18 for five minutes after launching to allow the target to climb to the set operating depth. The response of the sequence-timer motor 70 and the retriever weight solenoid 96 to the moving of switch 67 depends on the setting of the practice plug 26 which consists of jumper 206 for the sequence-timer motor circuit and a jumper 207 for the retriever weight release circuit. With the practice plug installed, as in a practice run, the sequence-timer motor continues to run since power is taken from switch 65, through lead 68, jumper 206, lead 69, and is connected to the sequence-timer motor 70. The hydrostatic switch 18 is connected through the jumper 207 to the retriever weight release solenoid 96. When jumpers 206 and 207 are removed for a combat run the sequence-timer motor 70 and the retriever-weight-release-solenoid 96 are disconnected from any source of power and the target will continue to operate until the battery is exhausted and the target sinks.

On a practice run, twenty minutes after the target is launched, switch 64 is moved to the opposite position and the retriever-weight-release-solenoid 96 is energized, the weight 27 is dropped and the target returns to the surface. The retriever weight release mechanism consists of a shoulder on the retriever weight 27 which is engaged by a sliding spring-loaded armature of the solenoid 96. Since the retriever weight has a density greater than water, when the solenoid is energized, the weight falls free of the target. The weight and balance of the target are substantially effected by the release of the retriever weight because the weight is located in the nose of the target and its release not only makes the target positively buoyant, but also lightens the nose of the target so that forward movement will tend to drive the target to the surface. After each practice run, as previously explained, cams in the sequence timer 15 must be re-set and a new retriever weight and recharged battery must be installed.

Although illustrated here by its embodiment in a specific construction, the invention is capable of modifications and variations within the scope of the appended claims.

We claim:

1. In combination in a free, underwater craft, a hull, means for carrying ballast, means for discharging said ballast, depth responsive means, a timer providing two time intervals, control means operated by said timer for actuating said discharging means after a pre-set time interval, and other control means operated by both said timer and said depth responsive means for actuating said discharge means after a shorter time interval if said craft attains a pre-set depth.

* * * * *